US005254166A

United States Patent [19]

Tu

[11] Patent Number: 5,254,166

[45] Date of Patent: Oct. 19, 1993

[54] STRIP COATING DEVICE HAVING JET STRIPPERS TO CONTROL COATING THICKNESS

[75] Inventor: Cat V. Tu, Corrimal East, Australia

[73] Assignee: John Lysaght (Australia) Limited, Sydney, Australia

[21] Appl. No.: 845,939

[22] Filed: Mar. 6, 1992

[30] Foreign Application Priority Data

Mar. 6, 1991 [AU] Australia ..... 72689/91

[51] Int. Cl.[5] ..... B05K 11/06

[52] U.S. Cl. ..... 118/63; 34/155; 34/160; 15/309.1; 118/600

[58] Field of Search ..... 34/155, 156, 160, 152; 118/21, 63, 600; 15/309.1

[56] References Cited

U.S. PATENT DOCUMENTS

| | | | |
|---|---|---|---|
| 2,992,941 | 7/1961 | Whitley | 118/63 |
| 4,128,668 | 12/1978 | Ernest | 118/63 |
| 4,425,869 | 1/1984 | Hull | 118/316 |
| 4,444,814 | 4/1984 | Flinchum | 118/65 |

FOREIGN PATENT DOCUMENTS 581081 2/1989 Australia .

*Primary Examiner*—W. Gary Jones
*Assistant Examiner*—John Hoffmann
*Attorney, Agent, or Firm*—Nikaido, Marmelstein, Murray & Oram

[57] ABSTRACT

A jet stripping apparatus includes two dual-nozzle assemblies (12) which, when in use, are disposed one on either side of an ascending, substantially vertical steel strip (10) which is to be partly stripped of a molten zinc or aluminium/zinc alloy coating (19). Each assembly comprises upper and lower elongate nozzles (13,14) extending transversely of the strip, a device to supply pressurized gas (15) to the nozzles for emergence therefrom as jet streams (20,21) directed towards the strip, and a reaction body (16) intermediate the nozzles defining a pressurized stabilizing zone (17) between itself and the strip. The lower jet streams are inclined downwardly at 5° to the horizontal.

7 Claims, 3 Drawing Sheets

STRIP COATING DEVICE HAVING JET STRIPPERS TO CONTROL COATING THICKNESS

TECHNICAL FIELD

The present invention relates to apparatus of the kind used to remove excess liquid coating from a moving strip emerging from a coating bath and which operate by directing jet streams of pressurized gas onto the coated surfaces of the strip.

The invention was developed to control the thickness of the zinc or aluminium/zinc alloy coating applied to steel strip in a continuous hot dip galvanizing plant, and is described primarily in that context hereinafter. It will be understood, however, that the apparatus of the invention is equally applicable to the control of liquid coatings generally on any moving strip substrate.

BACKGROUND ART

In a typical metal coating process, a strip of metal to be coated, after preliminary treatment, passes downwardly into a bath of molten coating metal, around a sink roll submerged in the bath, upwardly past at least one deflector roll located just below the surface of the bath, through jet stripping apparatus, and to and about a turn-round roll located above the bath.

The turn-round roll is the first solid object to contact the coated strip, and it is necessary for the coating to have solidified before contact is made. Having regard to the speed of operation of modern plants, the turn-round roll is, therefore, a considerable distance above the bath, even though strip coolers may be provided, so as to ensure that the coating solidifies before it reaches the roll.

Traditionally, jet stripping apparatus has comprised an elongate nozzle on each side of the strip transversely of the strip and directing a horizontal, substantially planar, jet stream of gas against the vertical strip.

Because of its length, the unsupported strip between the bath and the turn-round roll tends to vibrate. The vibrations cause variations in the distances between the strip and the respective nozzles and this results in objectionable variations in the coating thickness.

To overcome that disability it has been proposed to replace each single nozzle on each side of the strip with a dual-nozzle assembly comprising upper and lower, parallel nozzles, spaced apart by a reaction body.

Such a dual-nozzle apparatus is described in the complete specification of Australian patent No. 581081.

When that apparatus is operating a static pressure is developed in the space between the reaction body and the strip, which space is referred to as the "stabilizing zone" hereinafter.

The magnitude of the pressure in the stabilizing zone, for constant gas supply pressures to the nozzles, depends markedly upon the distance between the strip and the reaction body. If the strip departs from a mid-position between the reaction bodies, the pressure in the then narrower stabilizing zone rises, and the pressure in the then wider stabilizing zone falls, so that a restoring force is generated tending to maintain the strip at the desired mid-point and opposing any vibrational movement of the strip.

Such prior known dual-nozzle jet stripping apparatus is very effective at preventing variations in coating thickness due to strip vibration, but it has been found that it induces undesirable surface roughness into the finished coating.

DISCLOSURE OF THE INVENTION

In relation to such prior known dual-nozzle apparatus it was thought that both nozzles of each assembly were required to direct the gas jet streams so that both jet streams were inclined from the horizontal inwardly towards the stabilizing zone to provide the requisite static pressure in that zone. The angle of inclination of such inward inclination is deemed to be a positive angle of inclination hereinafter, whereas an angle of inclination whereby gas flow is directed outward of the stabilizing zone is deemed to be negative.

From investigations leading to the present invention it became apparent that the two lower gas jet streams were almost wholly responsible for the stripping action. It also appeared that the undesirable roughness in the finished coating was mainly due to unsteadiness in the lower jet streams and positional instability of their lines of impingement on the strip.

It was hypothesized that the acute directional change in the flow path of the gas jet stream from each lower nozzle was responsible for the instability, and experimental work leading to the invention has confirmed that hypothesis.

Further investigation showed that the prior held belief that the two jet streams of each dual-nozzle assembly had to be at least partly in opposition to attain adequate pressure in the aforesaid stabilizing zone was ill founded, in that adequate pressure could be obtained even with the lower jet stream inclined downwardly, that is to say outwardly of the stabilizing zone and therefore at a negative angle of inclination, provided the jet streams were directed to impinge on the strip and there was sufficient gas flow.

Therefore, the invention consists in a jet stripping apparatus of the kind comprising two dual-nozzle assemblies which, when in use, are disposed one on either side of an ascending, substantially vertical strip which is to be partly stripped of liquid coating, and each comprising upper and lower elongate nozzles extending transversely of the strip, means to supply pressurized gas to said nozzles for emergence therefrom as gas jet streams directed towards the strip, and a reaction body intermediate the nozzles defining a pressurized stabilizing zone between itself and the strip, characterised in that the gas jet stream from the lower nozzle of each assembly is directed in a downwardly inclined direction, that is to say at a negative angle of inclination.

It was also found that with the lower jet streams so directed their stripping capability was greatly enhanced, permitting faster strip travel for a given coating thickness, while obtaining a smooth coating and retaining the even coating thickness inherent dual-nozzle apparatus.

For preference, the jet streams from the upper nozzles are also inclined downwardly, that is to say inwardly of the respective stabilizing zones at a positive angle of inclination. For preference the gas flow from the lower nozzles may be increased, by comparison with that of prior art apparatus, to compensate for their lesser contribution to the stabilizing action.

In those instances in which both nozzles of each dual-nozzle assembly have the same supply pressure, for example, when fed from a common plenum chamber, the compensation may be achieved if the relationship between the widths of the outlets of the nozzles are related in accordance with the following equation $$\frac{d_2}{d_1} = \underbrace{\left\{\frac{1+\sin(\alpha_1)}{1+\sin(\alpha_2)}\right\}}_{\text{(I)}} \underbrace{\left\{\frac{1-e^{-0.322\frac{Y}{d_1}}}{1-e^{-0.322\frac{Y}{d_2}}}\right\}}_{\text{(II)}}$$

where $d_1$, $d_2$, $\alpha_1$, $\alpha_2$, and Y denote the lower nozzle width, the upper nozzle width, the angle of inclination of the lower jet, the angle of inclination of the upper jet and the distance of the reaction body from the strip respectively, the angle of inclination of a jet being deemed positive or negative in accordance with the convention adopted herein as stated above.

Term (II) of that equation indicates that the relationship between $d_1$ and $d_2$ depends to a certain extent on Y. However in practice, where Y falls within a preferred range of from 5 to 20 mm, and thus Y is large by comparison with $d_1$ or $d_2$, term (II) approaches unity and effectively the relationship between $d_1$ and $d_2$ depends on $\alpha_1$ and $\alpha_2$ as shown by term (I).

BEST MODE OF CARRYING OUT THE INVENTION

Figure 1:
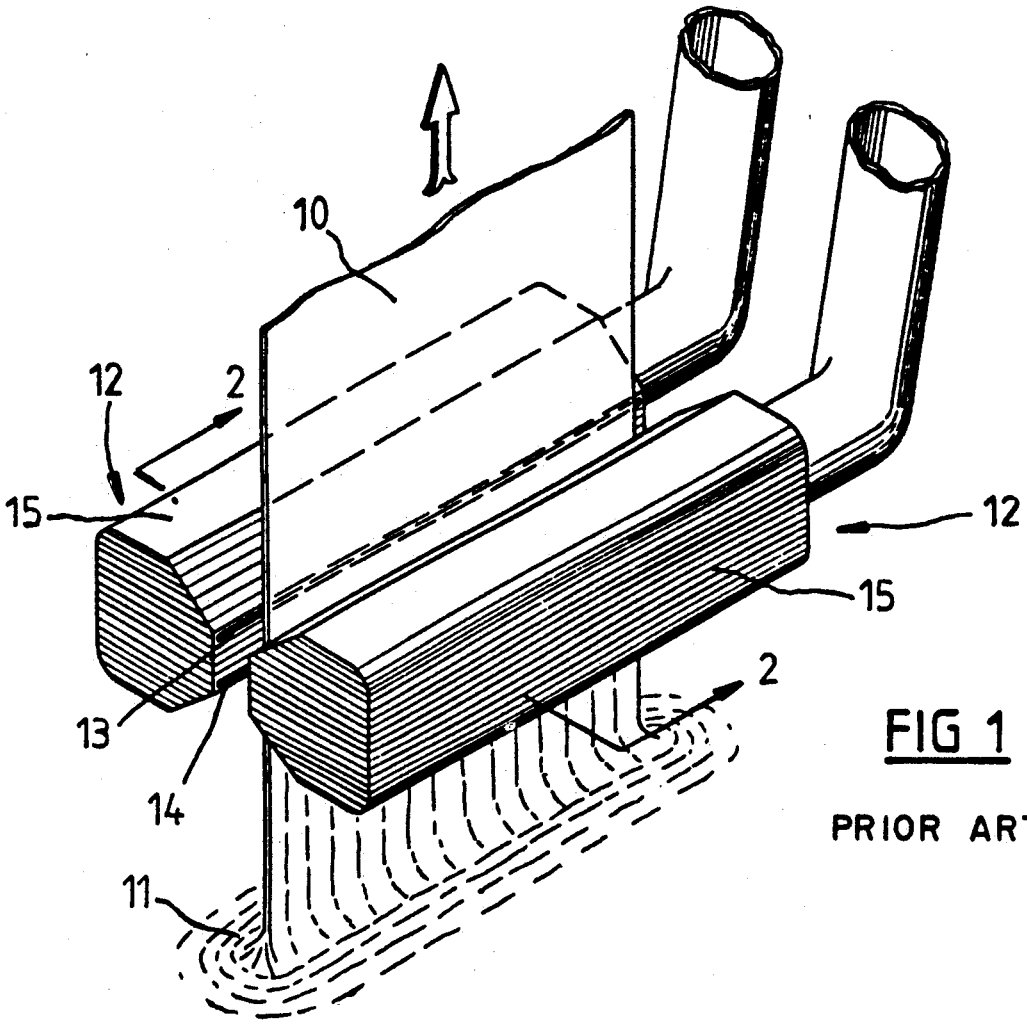
FIG 1 PRIOR ART
FIG. 1 is a diagrammatic perspective view of a prior art dual-nozzle jet stripping apparatus.
Figure 2:
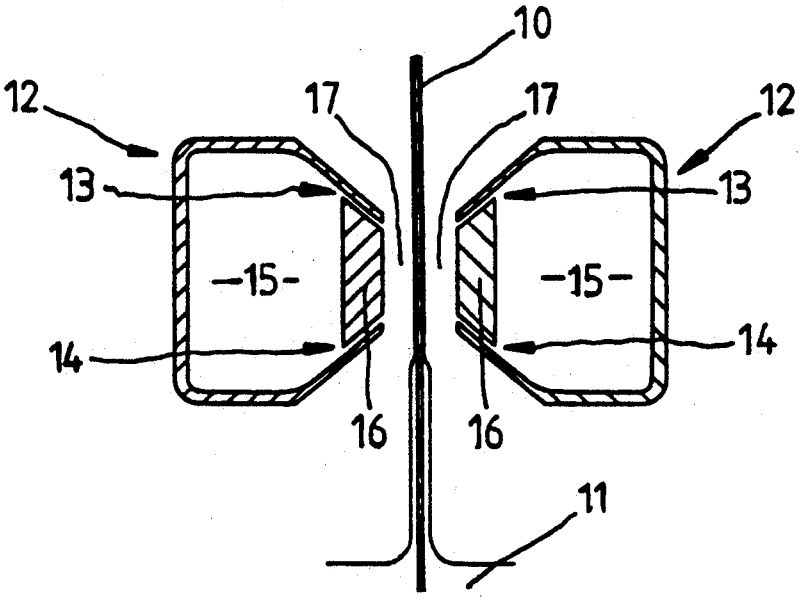
FIG 2 PRIOR ART
FIG. 2 is a diagrammatic cross-sectional view taken on line 2—2 of FIG. 1.

As shown in FIGS. 1 and 2 a strip 10 emerges from a bath 11 and passes between two dual-nozzle assemblies 12. Each assembly 12 is in accordance with the prior art and comprises two elongate nozzles, namely an upper nozzle 13 and a lower nozzle 14, fed with stripping gas from a pressurized plenum chamber 15 and spaced apart by the front wall 16 of the chamber.

The front wall 16 therefore constitutes a reaction body providing a reaction surface defining one side of a stabilizing pressure zone 17. Other factors remaining constant, the static pressure within the stabilizing zone 17 depends on the spacing between the front wall 16 and the strip 10. In accordance with that which was previously regarded as essential, both the upper nozzles 13 and the lower nozzles 14 are inclined so as to direct their jet streams inwardly of the pressure zone 17, that is to say, in accordance with the convention adopted herein, both angles of inclination are positive.

Figure 3:
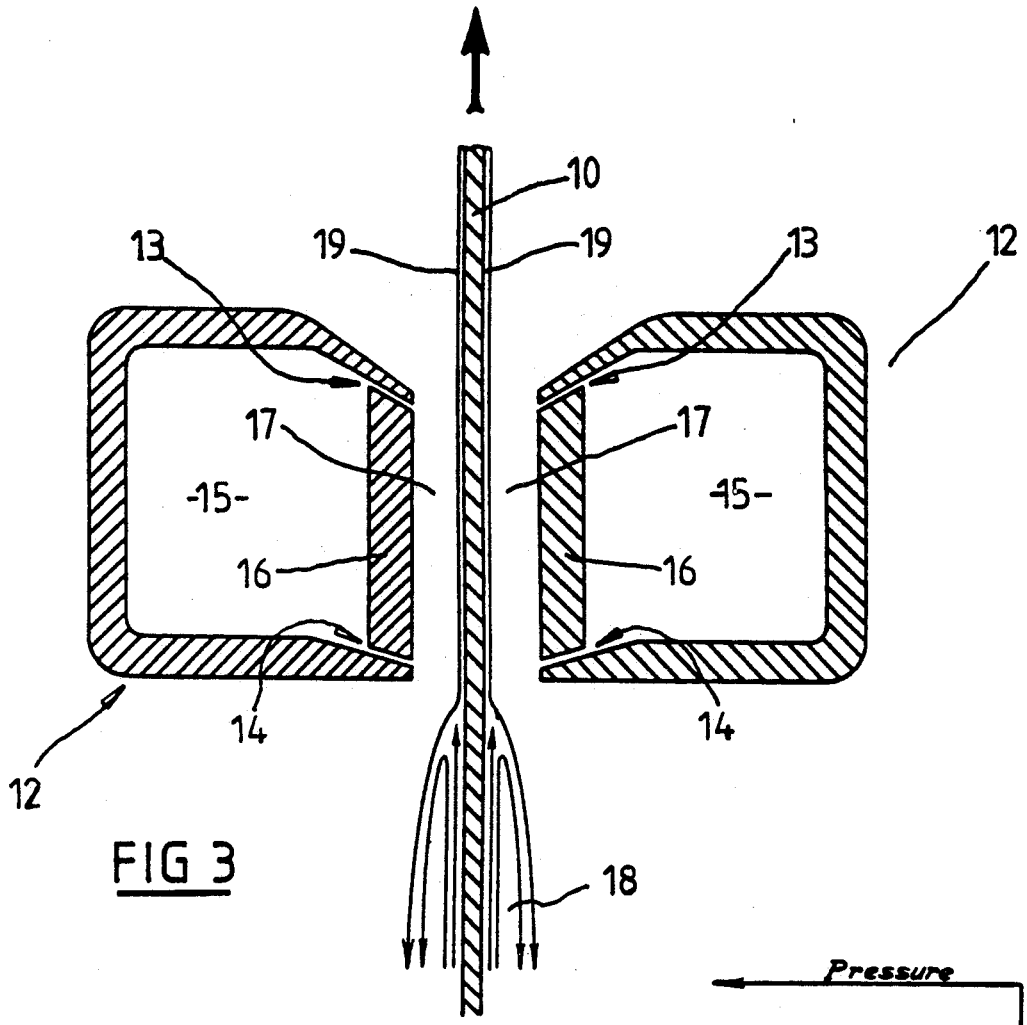
FIG. 3 is a view similar to FIG. 2 of a dual-nozzle jet stripping apparatus according to the invention.
Figure 4:
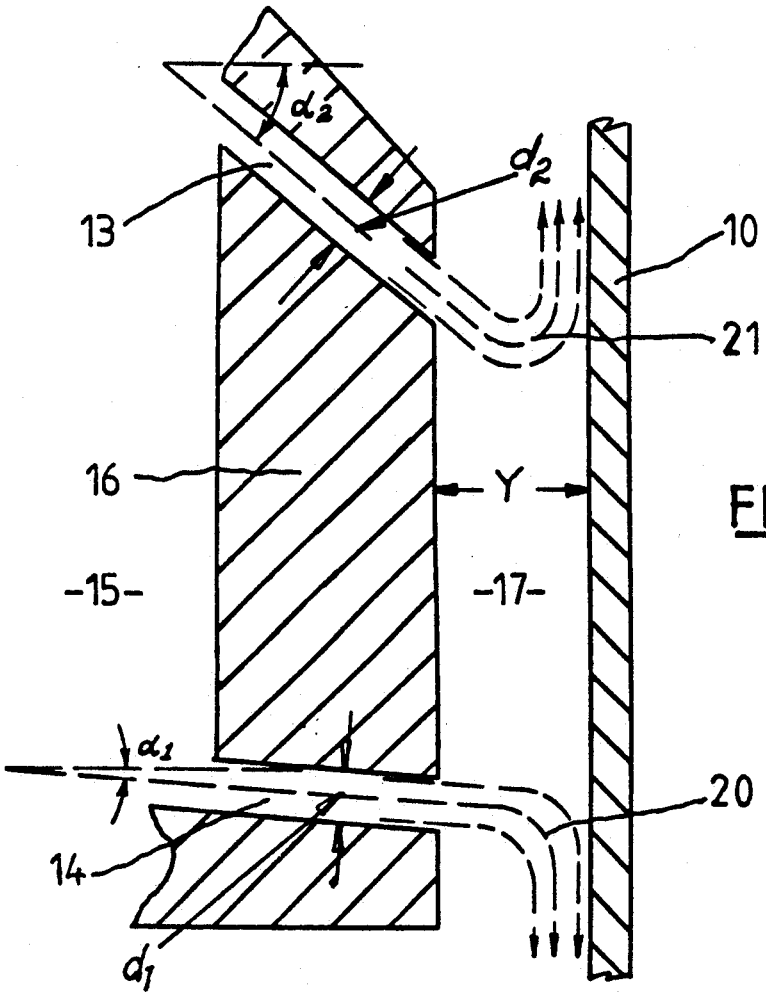
FIG. 4 is a sectional view of the strip and one nozzle assembly of the apparatus of FIG. 3 drawn to a larger scale and indicating the upper and lower gas jet streams.

The embodiment of the invention illustrated by FIGS. 3 and 4 is the same as the prior art apparatus of FIGS. 1 and 2 except for the crucial change in the angle of inclination of the lower jet streams of each dual-nozzle assembly.

Corresponding components bear corresponding reference numerals in the respective figures, and further detailed description of the preferred embodiments of the invention is limited to the differences between them and the prior art.

In FIG. 3 the coating material picked up by the strip 10 and its partial return to the bath is indicated at 18. The unstripped residue, constituting the finished coat on the strip, is shown at 19. Thus it will be seen that virtually all of the stripping is effected by the lower gas jet stream 20 (see FIG. 4) emanating from the lower nozzle 14, whereas the upper jet stream 21 serves principally to maintain pressure within the stabilizing zone. It is mentioned however, that the upper jet stream 21 does have a flattening action on the coating, enhancing the smoothness of the finished coated product.

In accordance with the invention the angle of inclination of the lower gas jet stream to the horizontal $\alpha_1$ is $-5°$ whereas the angle of the upper jet stream $\alpha_2$ remains at the conventional figure of $+40°$. Thus, in accordance with term (I) of the above mentioned equation the relationship $d_2/d_1$, between the widths $d_2$ and $d_1$ of the upper and lower nozzles 13 and 14 respectively, is $(1+\sin(-5°))/(1+\sin(40°)$, that is approximately 0.556. Thus, for those angles of inclination and a preferred value of 1.1 mm (which is appropriate to a gas pressure within the plenum chambers 15 of from 10 to 45 kPa.) for the width $d_1$ of the lower nozzle, the upper nozzle would preferably have a width $d_2$ of 1.1 mm$\times$0.556 or 0.6 mm to the nearest tenth of a millimeter. This assumes a value for Y which is large by comparison to 1.1 mm, if that assumption does not apply in any instance, then term (II) of the above equation should be taken into account. In the illustrated embodiment Y is substantially 7 mm, and the spacing between the upper and lower nozzle openings is of the order of 80 mm.

Figure 5:
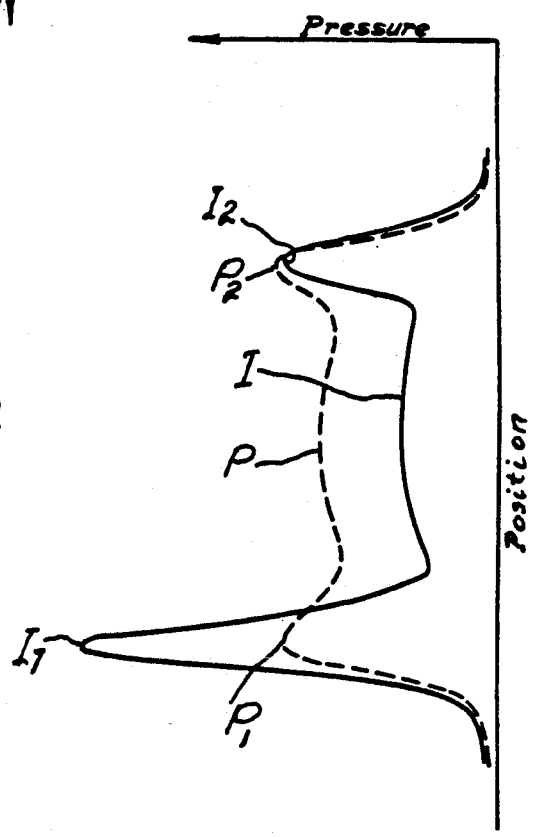
FIG. 5 is a graph showing the pressure distribution within and adjacent a stabilizing zone of the prior art apparatus of FIG. 2 and of the apparatus of FIGS. 3 and 4.

FIG. 5 shows typical static pressures within and at the ends of the stabilizing zone for both the prior art apparatus of FIGS. 1 and 2 (the broken line curve) and the embodiment of the invention of FIGS. 3 and 4 (the full line curve), for the same pressure within their respective plenum chambers 15. It can be seen with regard to the prior art that the curve is substantially symmetrical with substantially equal peak pressures at $P_2$ and $P_1$, being at the areas of impingement on the strip of the upper and lower jet streams, with a substantial and generally constant static pressure P therebetween. On the other hand the curve of the embodiment of the invention now being described is unsymmetrical, with an upper peak pressure $I_2$ substantially the same as $P_2$ and a lower peak pressure $I_1$ which is considerably greater in value than the corresponding $P_1$. Furthermore the shape of the pressure peak culminating in $I_1$ is appreciably sharper, that is to say it has steeper flanks than the prior art peak culminating in $P_1$. It is these characteristics of the lower jet streams of apparatus according to the invention which results in the marked increase in its stripping capability, and the consequent, commercially significant increase in possible strip speed, for given coating thickness and gas usage, offered by the invention.

It will be noticed that the generally constant strip stabilizing pressure I is less than P. Nevertheless it is still adequate for controlling the position of the strip between the two dual-nozzle assemblies.

Figure 6:
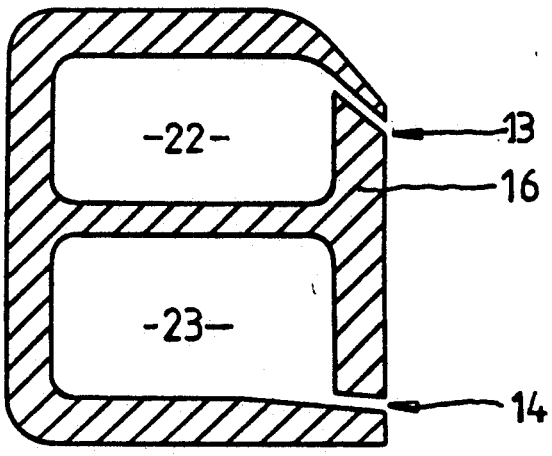
FIG. 6 is a cross sectional view of a dual-nozzle assembly of another embodiment of the invention.

FIG. 6 illustrates a second embodiment of the invention wherein the angles of inclination of the gas jet streams of each assembly may be the same as those of the first described embodiment. In any event the angle of inclination of each of the lower jets is negative. The present embodiment differs from the earlier described embodiment in that separate plenum chambers 22 and 23, one feeding the upper nozzle 13 and the other feeding the lower nozzle 14, replace the single chamber 15 in each assembly of the first described embodiment. This enables the gas pressure to each nozzle to be varied so as to independently vary the gas flow rate from each of them. It follows that the preferred relationship between the widths of the upper and lower nozzles referred to above may no longer pertain.

It will be appreciated that the angle of inclination of the upper jet streams is not critical. The 40° positive angle described may be reduced if desired, even to the extent of becoming negative. However no particular advantage accrues from such a change. Indeed it reduces the gas pressure in the stabilizing zone and therefore may require a greater gas flow rate in the upper jet streams to obtain adequate control of the position of the strip. This is wasteful of gas. Therefore a positive angle of 40° or thereabouts is presently preferred.

I claim:

1. A strip coating apparatus having a jet stripping means comprising:

two dual-nozzle assemblies which, when in use, are disposed one on either side of an ascending, substantially vertical strip which is to be partly stripped of liquid coating, each dual nozzle assembly comprising upper and lower elongate nozzles extending transversely of the strip;

means to supply pressurized gas to said upper and lower elongate nozzles for emergence therefrom as jet streams directed towards the strip; and a reaction body intermediate the upper and lower elongate nozzles defining a pressurized stabilizing zone between itself and the strip, wherein the lower nozzle of each assembly is directed in a downwardly inclined direction such that any jet stream emerging therefrom is in a downwardly inclined direction.

2. A strip coating apparatus according to claim 1 wherein said means to supply pressurized gas provide the same pressure to each nozzle and wherein the widths of the outlets of the nozzles of each dual-nozzle assembly are in substantial accordance with the following equation $$\frac{d_2}{d_1} = \left\{ \frac{1 + \sin(\alpha_1)}{1 + \sin(\alpha_2)} \right\} \left\{ \frac{1 - e^{-0.322 \frac{Y}{d_1}}}{1 - e^{-0.3222 \frac{Y}{d_2}}} \right\}$$

where $d_1$, $d_2$, $\alpha_1$, $\alpha_2$, and Y denote the lower nozzle width, the upper nozzle width, the angle of inclination of the lower jet stream, the angle of inclination of the upper jet stream and the distance of the reaction body from the strip respectively, the angle of inclination of a jet stream being deemed positive when the jet stream is directed inwardly of the stabilizing zone and being deemed negative when the jet stream is directed outwardly of that zone.

3. A strip coating apparatus according to claim 2 wherein said means to supply pressurized gas comprise a plenum chamber for each dual-nozzle assembly from which both the upper and lower nozzles of that assembly are fed.

4. A strip coating apparatus according to claim 1 wherein said means to supply pressurized gas provide independently variable pressures to the upper and lower nozzles of each dual-nozzle assembly.

5. A strip coating apparatus according to claim 2 wherein the width of each upper nozzle is substantially 0.6 mm and the width of each lower nozzle is substantially 1.1 mm.

6. A strip coating apparatus according to claim 3 wherein the pressure within the plenum chamber is within the range of from 10 to 45 kPa.

7. A strip coating apparatus according to claim 1 wherein the angle of inclination of each lower gas jet stream is substantially 5° with respect to the horizontal.

* * * * *